United States Patent [19]

Focke

[11] Patent Number: 4,517,791

[45] Date of Patent: May 21, 1985

[54] APPARATUS FOR GROUPING CIGARETTE CARTONS AND LOADING CONTAINERS THEREWITH

[75] Inventor: Heinz Focke, Verden, Fed. Rep. of Germany

[73] Assignee: Focke & Co., Verden, Fed. Rep. of Germany

[21] Appl. No.: 354,005

[22] Filed: Mar. 2, 1982

[30] Foreign Application Priority Data

Mar. 19, 1981 [DE] Fed. Rep. of Germany ..... 3110720

[51] Int. Cl.[3] ..... B65B 5/06; B65B 19/12

[52] U.S. Cl. ..... 53/566; 53/252; 53/537; 53/541; 53/544; 198/374; 414/96

[58] Field of Search ..... 53/284, 535, 537, 538, 53/540, 541, 544, 566, 531, 448, 443, 533, 252, 543; 198/374, 412, 414; 414/46, 103, 96, 62

[56] References Cited

U.S. PATENT DOCUMENTS

| | | | |
|---|---|---|---|
| 2,738,116 | 3/1956 | Barraclough | 53/537 |
| 2,972,842 | 2/1961 | Hitchcock | 53/543 |
| 3,022,615 | 2/1962 | Schroeder et al. | 53/566 |
| 3,100,039 | 8/1963 | Oderman et al. | 198/414 |
| 3,513,623 | 5/1970 | Pearson | 53/252 |
| 3,566,574 | 3/1971 | Salwasser | 53/543 |
| 3,595,370 | 7/1971 | Fujishiro | 198/374 |
| 3,669,283 | 6/1972 | Brown, Jr. | 198/374 |
| 3,799,320 | 3/1974 | Bilt | 198/414 |
| 4,258,532 | 3/1981 | Dilot | 53/538 |

FOREIGN PATENT DOCUMENTS

| | | | |
|---|---|---|---|
| 2205153 | 9/1973 | Fed. Rep. of Germany | 198/414 |
| 2733464 | 12/1978 | Fed. Rep. of Germany | 198/412 |

*Primary Examiner*—John Sipos
*Assistant Examiner*—Donald R. Studebaker
*Attorney, Agent, or Firm*—Sughrue, Mion, Zinn, Macpeak and Seas

[57] ABSTRACT

Cigarette cartons 12 fed in by conveyor 13 are stacked in a group 14 and then laterally displaced by pusher 26 onto a turntable 27. A further pusher 29 then inserts the group into an awaiting, open ended shipping container 10 or 11, either with or without a 90° turntable rotation depending upon the type of packaging being performed.

6 Claims, 7 Drawing Figures

11
12
13
14
15
16
17
18
19
20
21
22
23
24
26
27
28
29
30
31
32
33
35
36
42

APPARATUS FOR GROUPING CIGARETTE CARTONS AND LOADING CONTAINERS THEREWITH

BACKGROUND OF THE INVENTION

The invention relates to an apparatus for introducing articles or groups of articles, especially multi-pack cigarette cartons, into an open shipping container, it being possible to feed the articles or groups in a position offset at 90° relative to the arrangement within the container.

Higher performances are increasingly demanded even in the packaging of relatively large-volume articles. This is true especially in the sector of goods for mass consumption. Cigarettes are some of the products which are manufactured in unusually large quantities and are then packaged into ever larger bundles. A generally known conventional bundle consists of several, usually twenty, combined cigarette packs (the so-called multi-pack cigarette carton). These bundles, themselves combined in a larger group, have to be introduced into corresponding large containers. The invention deals primarily with problems in the packaging of multi-pack cigarette cartons in large containers.

SUMMARY OF THE INVENTION

The object on which the invention is based is to form, in an appropriate way favourable in packaging terms, groups consisting of a plurality of multi-pack cigarette cartons or the like and then to introduce these in a suitable way into a large cuboid shipping container.

To achieve this object, the apparatus according to the invention is characterised in that groups of cigarette cartons can be pushed onto a turntable and rotated through 90° by the latter before further transport.

The groups of cigarette cartons can be fed and/or grouped within the large container in different ways. The relative position of the cartons during feeding to the packaging station according to the invention is the same. The individual cartons lying next to one another are aligned with their longitudinal axes transverse to the conveying direction. In this position, groups consisting of a plurality of cartons are then formed first in a known way by stacking in layers. Then, in a transport track transverse to the conveying track for the oncoming cigarette cartons, each group is pushed off into an intermediate station. From this, the groups are again conveyed further, offset at 90°, and, at the same time, are pushed into the open container. Consequently, the path of movement of the cartons or groups is deflected twice through 90°.

This "offset" transport path is predetermined. However, to enable different orientations of the cigarette cartons within the container, the group can be rotated through 90° in the region of the intermediate station by the turntable. But the intermediate station with the turntable is designed so that the groups can be conveyed further, and into the container, without rotation, in the way described.

A further special feature of the invention is that the groups are supported and fixed on the turntable by lateral retaining walls rotatable together with the turntable. As a result, the groups can be pushed on to the turntable on one side and pushed off from the latter on the opposite side.

At least one of the retention walls on the turntable is lowerable so that, if required, it can be lowered into a position underneath the supporting plane of the turntable. It is thereby possible to use the apparatus equipped with the turntable alternatively also for those packaging operations in which rotation of the group is not necessary for introduction into the container.

BRIEF DESCRIPTION OF THE DRAWINGS

The individual process steps and particular features of the apparatus according to the invention are explained in more detail below with reference to exemplary embodiments illustrated in the drawings, in which.

DETAILED DESCRIPTION OF THE PREFERRED EMBODIMENTS

Figure 1:
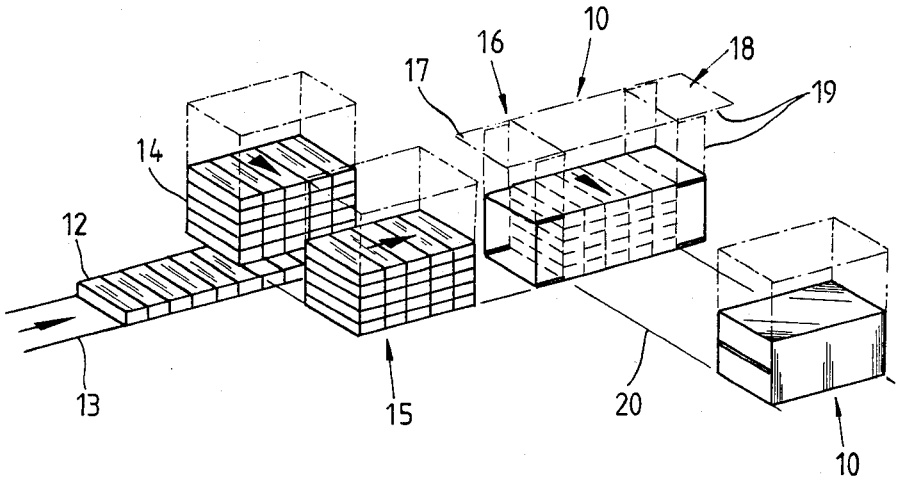
FIG. 1 shows, in perspective, a cycle of movement for filling containers without rotating the container contents.

The details of the package, the packaging process and the apparatus which are shown in the drawings relate to the preferred area of application, namely to the production or filling of large shipping containers 10 and 11 for receiving individual articles, namely elongate cuboid individual cartons, especially multi-pack cigarette cartons 12.

The feed of the cigarette cartons 12 on a conveying track 13 with longitudinal axes pointing transversely to the conveying direction (cross-conveyance) is the same for the various embodiments. Groups 14 are formed from the cartons 12, which are supplied close-packed and lying flat. These groups consist of several superimposed layers of cartons oriented in the same direction and lying close against one another. In the present embodiments, each group 14 consists of 25 cigarette cartons 12, which are arranged in five layers on top of one another.

The groups 14 are formed by lifting the cartons 12 in layers from the conveying track 13. The group 14 is thus formed above the conveying track 13. As soon as the group 14 is complete, it is pushed off, transversely to the transport direction of the conveying track 13, into an intermediate station 15. From this, the group 14 is transported further, approximately parallel and offset to the conveying track 13, into the open container 10.

The container 10 is appropriately a corrugated container with an opening 16 which can be closed in a known way by flaps 17 which are foldable over one another. Here, opposite the opening 16 there is a bottom opening 18 which can be closed by bottom flaps 19. With the flaps 17 swung back, the opening 16 faces the oncoming group 14.

In the embodiment according to FIG. 1, the relative position of the cartons 12 within the group 14 is not changed in respect of the original position. As a result, with the cartons 12 lying transversely, the group 14 is pushed into the container 10. Consequently, within the latter, the cartons 12 are aligned transversely to the openings 16 and 18.

In the embodiment according to FIG. 1, even two groups 14 can be accommodated in a common container 10. In this case, as indicated by dot-and-dash lines, a group of, for example, twice the size of the group 14 illustrated is formed and is introduced, again as a whole, into the container 10, which is made correspondingly larger.

After the container has been closed, it is transported away by a discharge conveyor track 20.

Figure 2:
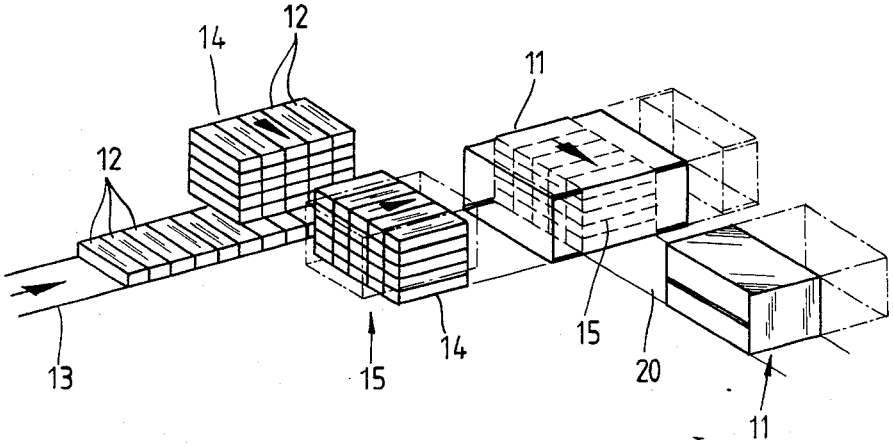
FIG. 2 shows an illustration corresponding to FIG. 1, for an embodiment with rotation of the container contents.

The embodiment according to FIG. 2 is characterised by a special position of the cigarette cartons 12 within the container 11. As illustrated, here the cartons 12 are aligned transversely to the plane of the openings 16 and 18. This presupposes that the group 14, formed in the same way as the preceding embodiment, is rotated through 90° in the region of the intermediate station 15 and is only then introduced into the open container 11 as a result of further transport.

Here, larger containers 11 are made by forming two groups in succession, in the design of the group 14, and also introducing them in succession into the container 11, specifically in the relative position described, namely with the longitudinal axes of the cartons 12 aligned transversely to the plane of the openings 16 and 18. Consequently, here the two groups 14 lie next to one another, from the point of view of the longitudinal direction of the cartons 12. A correspondingly taller or longer container 11 is obtained as a result, as indicated by dot-and-dash lines in FIG. 2.

The apparatus shown in FIGS. 3 to 7 is suitable for the packaging of cigarette cartons 12 both according to FIG. 1 and to FIG. 2.

The conveyor track 13 for feeding the cartons 12 consists of a conveyor belt 21 with lateral, fixed guides 22. In the region of a grouping station 23, a particular group 14 is formed by lifting cartons 12 in timed sequences and receiving them in layers. For this purpose, a lifting device 24 is installed here, and this lifts a layer of cartons 12 and feeds them to the part group already formed. This is carried by catching strips 25 of a basically known design, which are mounted on the underside and which can be moved back for feeding a subsequent layer.

After a group 14 has been completed, it is pushed off from the catching strips 25 by a pushing-off device 26 and is fed to the intermediate station 15.

Here, the intermediate station 15 is formed by a turntable 27. The group 14 is deposited on the latter approximately in the middle or centrally by the pushing-off device 26. Located in front of the turntable 27 is an intermediate piece 28, forming a part of the conveyor track for supporting the group 14. The contour of this intermediate piece 28 matches that of the turntable 27.

As already described, the open container 10 or 11 is positioned parallel to the conveying track 13 and offset therefrom. Accordingly, the group 14 has to be pushed off from the turntable 27 by a pushing-in device 29 and pushed into the container either without rotation as in FIG. 1 or after previous rotation through 90° as in FIG. 2.

Figures 6, 7:
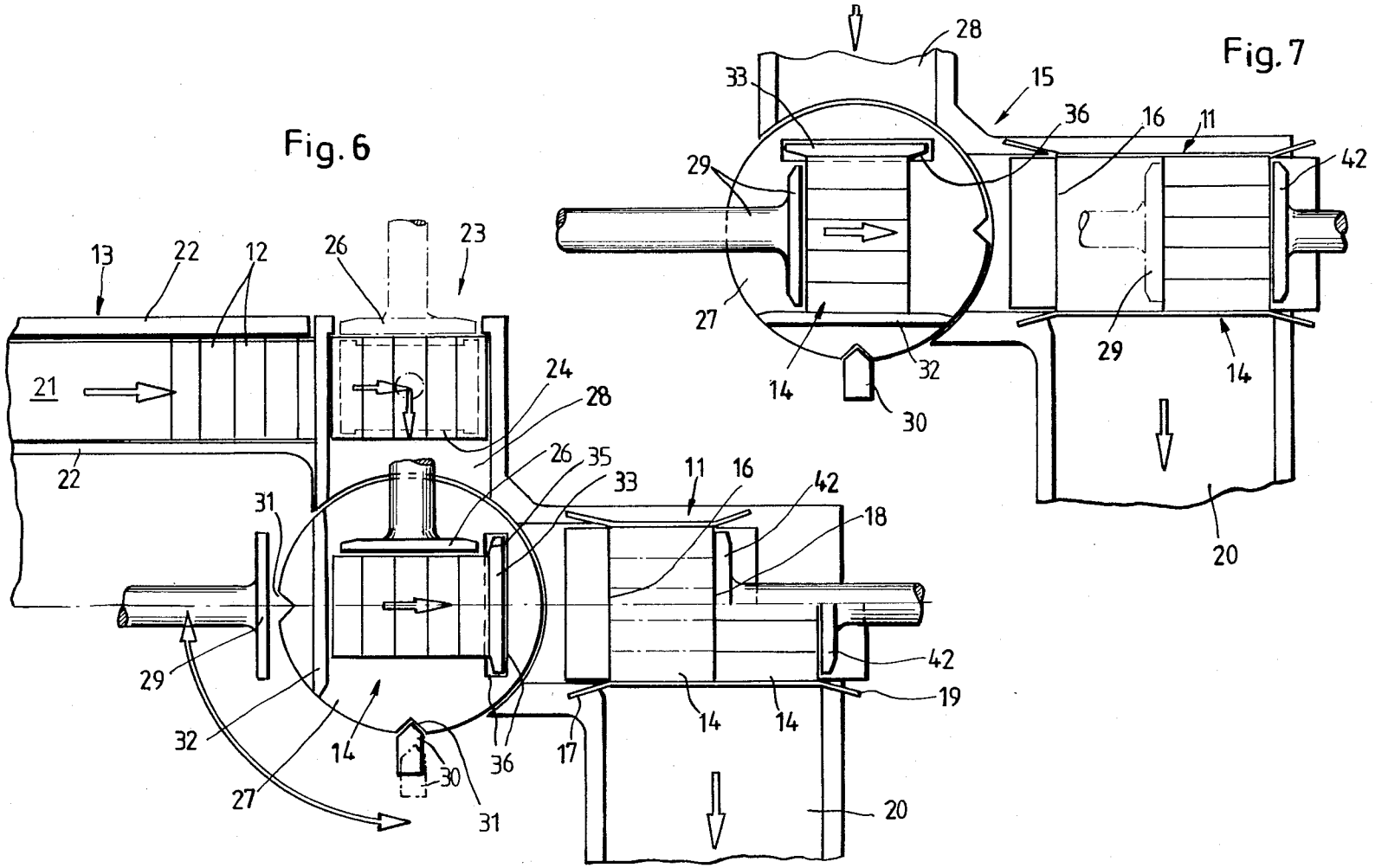
FIG. 6 shows, in a plan view, the apparatus according to FIGS. 3 to 5 for packaging the contents of a container to be rotated through 90°.
FIG. 7 shows, in a plan view, a cut-out portion of the apparatus according to FIG. 6, with a changed position of parts of the apparatus.

For executing a rotary movement of the group 14, the turntable 27, together with the group 14 resting on it, can be rotated through 90° in an anti-clockwise direction out of the position according to FIG. 6 into that according to FIG. 7. The end positions of the turntable 27 are fixed by an index pin 30 which penetrates into appropriate alternative recesses 31.

The group 14 is retained and centered on the turntable 27. For this purpose, the turntable 27 is fitted with laterally arranged retaining walls 32 and 33. These are located at a distance from one another, thus allowing the group 14 to be introduced between the retaining walls 32, 33 and pushed off faultlessly, but nevertheless guaranteeing fixing on the turntable 27. For this purpose, the two retaining walls 32 and 33 are provided with entry chamfers. The retaining walls 32, 33 allow the group 14 to be pushed on from one side and to be pushed off from the turntable 27 on the opposite side in the same direction. However, because of the predetermined relative position of the cigarette cartons 12, it is guaranteed that the formation of the group 14 on the turntable 27 is maintained.

The retaining wall 33, which extends on the side facing the container 10 or 11 when the group 14 is pushed on to the turntable 27, is arranged so as to be lowerable. In the retracted lower position (FIGS. 3 and 4), the retaining wall 33 lies completely underneath or with its upper termination in the plane of the supporting face of the turntable 27. For this purpose, the latter is provided with a slit 36 for the passage of the retaining wall 33. In the lowered position of the latter, the group 14 can be pushed off from the turntable 27 over and beyond the retaining wall 33. This position applies when the process steps according to FIG. 1 are carried out, that is to say without rotation of the group 14.

The retaining wall 33 is mounted, by means of a supporting leg 37, so as to be movable up and down on a vertical shaft 38 of the turntable 27, but is secured against rotation by a retaining screw 39. The shaft 38 and consequently the turntable 37 are driven via a gear wheel 40. As a result of this arrangement, the retaining wall 33 is always moved with the turntable 27.

Figure 3:
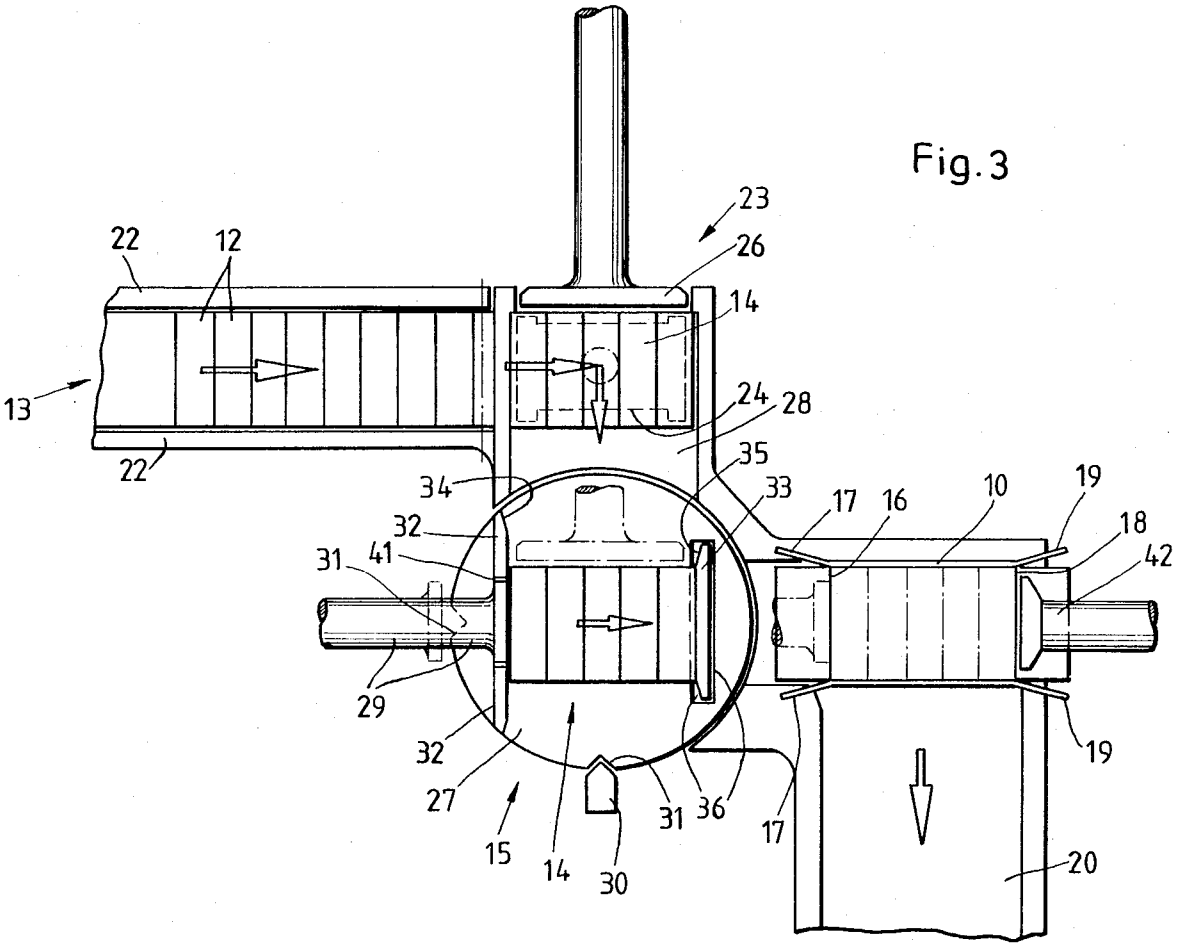
FIG. 3 shows a plan view of an apparatus for filling containers without rotation of the container contents.
Figure 4:
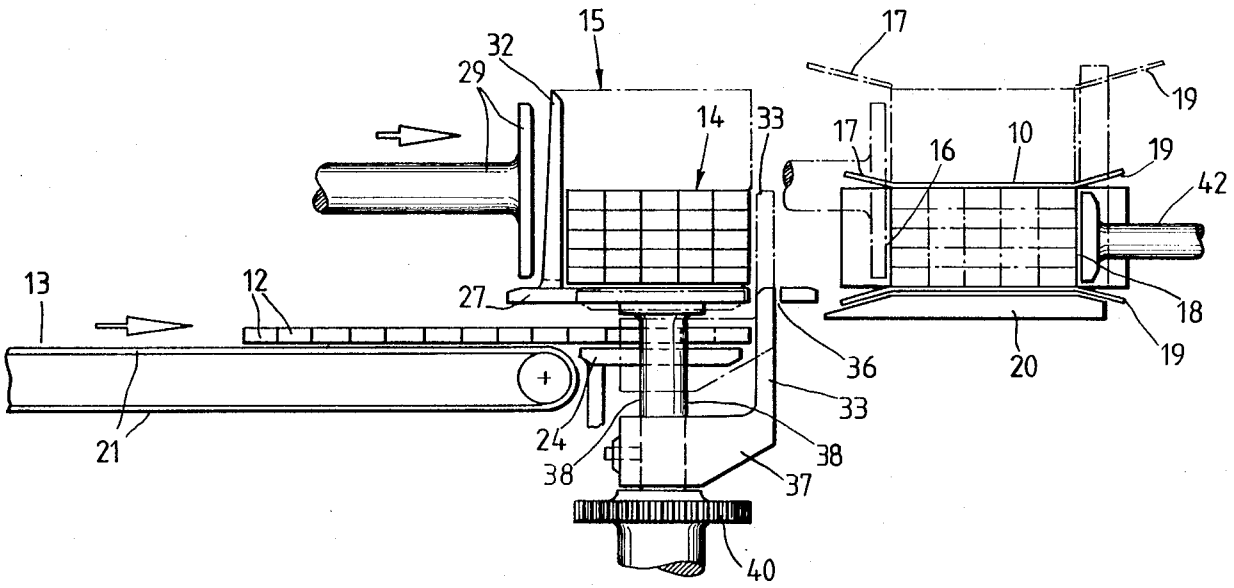
FIG. 4 shows, in a side view, the apparatus or parts of it.
Figure 5:
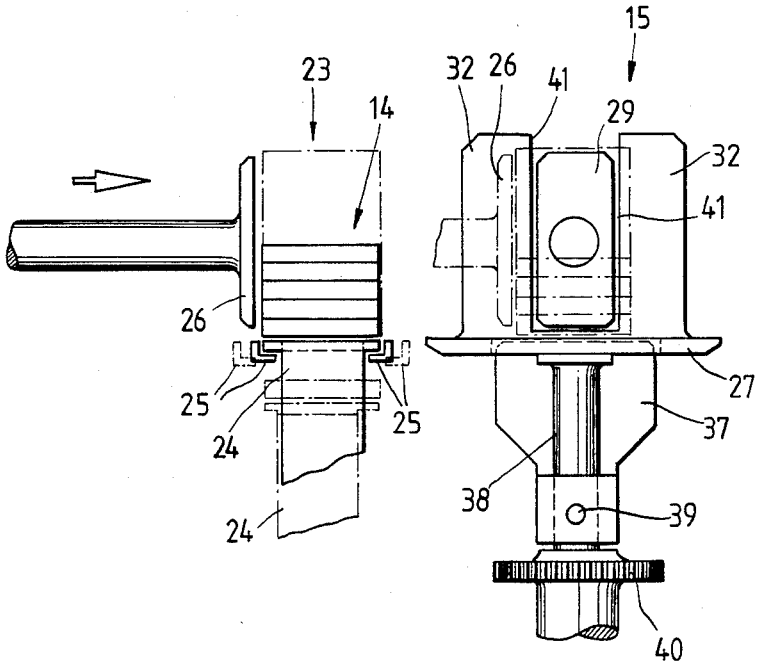
FIG. 5 shows a view of the apparatus according to FIGS. 3 and 4 in the feed direction.

The opposite retaining wall 32 is arranged fixedly, but is provided with an orifice 41 for the passage of the pushing-in device 29 when the group 14 is pushed off from the turntable 27 when carrying out the process according to FIG. 1, that is to say without rotation of the group 14, according to FIG. 3.

The groups 14 are pushed into the container 10 or 11 which is open at both ends. As an abutment for the introduced group 14 there is a displaceable stop slide 42 in the region of the bottom opening 18. This has special importance when the process according to FIG. 2 is carried out, because here the stop slide 42 can assume different stop positions (FIGS. 6 and 7), depending on whether one group 14 or two groups are to be introduced into the container 11. As is evident from FIG. 7, in the case of a container having two groups 14, the first group is pushed into and through the container up to the bottom opening 18 and is positioned there by resting against the stop slide 42. After that, the second group 14 is introduced into the container 11 by means of a correspondingly shorter stroke of the pushing-in device 29.

I claim:

1. An apparatus for inserting elongate cuboid packages, such as cigarette cartons, into an open-ended container, comprising:

(a) a grouping station (23), (b) an elongate supply conveyor (13) for transporting successive elongated cartons positioned perpendicularly thereto (12) to the grouping station, (c) means (24) at the grouping station for stacking successive layers of cartons into multi-pack groups, (d) a rotatable turntable (27) disposed adjacent the grouping station and laterally offset from the supply conveyor, (e) first pusher means (26) for laterally pushing individual carton groups out of the grouping station and onto the turntable, (f) means (20) disposed adjacent the turntable for supporting a container (10 or 11) with the plane of an open end (16) thereof facing the turntable and perpendicular to said supply conveyor, an insertion axis of the container being parallel to but laterally offset from the supply conveyor, (g) second pusher means (29) for pushing individual carton groups off of the turntable and into a container in a direction parallel to but laterally offset from the supply conveyor, (h) means for selectively rotating the turntable through 90° after the delivery of a carton group thereto and before the expulsion thereof by the second pusher means, whereby carton groups may be inserted into a container with the longitudinal axes of individual cartons in a group either parallel to the open end of a container without turning said turntable or perpendicular thereto with turning said turntable in dependence upon the relative dimensions of a carton group and a container, (i) a pair of spaced, parallel, vertical retaining walls (32, 33) mounted on the turntable and rotatable together therewith, said walls being mounted perpendicular to said supply conveyor during transfer of said carton groups onto said turntable for laterally supporting carton groups on the turntable, and (j) means for selectively lowering a one of the retaining walls closest said open container end into a position underneath the turntable when said turntable is not rotated such that an upper edge of said one wall extends no higher than a support face of the turntable.

2. Apparatus according to claim 1, wherein the turntable is provided with a slot (36) for the passage of the lowerable retaining wall.

3. Apparatus according to claim 1, wherein the lowerable retaining wall is mounted by a supporting leg (37) on a vertical shaft (38) of the turntable.

4. Apparatus according to claim 1, wherein the supporting means comprises a discharge conveyor oriented perpendicular to the supply conveyor, and the turntable is located in a region of convergence of said conveyors.

5. Apparatus according to claim 1, wherein a retaining wall (32) located opposite the lowerable retaining wall is fixedly mounted on the turntable and has an opening (41) for the passage of the second pusher means.

6. Apparatus according to claim 1, wherein two opposite ends of the container are open, and further comprising a stop slide (42) disposable in two alternate positions within an open container end remote from an open insertion end for positioning a carton group being pushed into the container.

* * * * *